US009089178B1

(12) United States Patent
Clarke

(10) Patent No.: US 9,089,178 B1
(45) Date of Patent: Jul. 28, 2015

(54) HEAD COVERING ASSEMBLY WITH ATTACHABLE HEADBAND

(71) Applicant: Pamela E Clarke, North York (CA)

(72) Inventor: Pamela E Clarke, North York (CA)

( * ) Notice: Subject to any disclaimer, the term of this patent is extended or adjusted under 35 U.S.C. 154(b) by 0 days.

(21) Appl. No.: 14/028,102

(22) Filed: Sep. 16, 2013

(51) Int. Cl.
*A41G 3/00* (2006.01)
*A41G 5/00* (2006.01)

(52) U.S. Cl.
CPC ..... *A41G 3/00* (2013.01); *A41G 3/0016* (2013.01); *A41G 3/0058* (2013.01); *A41G 5/0093* (2013.01)

(58) Field of Classification Search
CPC ..... A41G 3/00; A41G 3/0016; A41G 3/005; A41G 3/0075; A41G 3/0033; A41G 5/00; A41G 5/004; A41G 5/0073; A63H 3/44
USPC ..... 2/174, 918, DIG. 11; D28/92, 93; 446/296, 319, 394
See application file for complete search history.

(56) References Cited

U.S. PATENT DOCUMENTS

| | | | | |
|---|---|---|---|---|
| 3,433,234 | A * | 3/1969 | Klugmann | 132/53 |
| 3,910,292 | A * | 10/1975 | Izzo | 132/53 |
| D357,569 | S | 4/1995 | Jacobellis | |
| 5,657,774 | A * | 8/1997 | Niese | 132/54 |
| 5,806,535 | A * | 9/1998 | Becker | 132/54 |
| 6,257,244 | B1 * | 7/2001 | Williams | 132/54 |
| 7,461,661 | B2 * | 12/2008 | Chudzik et al. | 132/273 |
| D644,379 | S | 8/2011 | Vanesse | |
| 2004/0149299 | A1 * | 8/2004 | Kim | 132/54 |
| 2004/0168696 | A1 * | 9/2004 | Cox | 132/54 |
| 2005/0092341 | A1 * | 5/2005 | Padilla | 132/201 |
| 2006/0174905 | A1 | 8/2006 | Bias | |
| 2008/0047572 | A1 * | 2/2008 | Park | 132/53 |
| 2009/0235945 | A1 * | 9/2009 | Eaton | 132/105 |
| 2011/0259358 | A1 | 10/2011 | Applegate | |

* cited by examiner

*Primary Examiner* — Robyn Doan
*Assistant Examiner* — Tatiana Nobrega

(57) ABSTRACT

A head covering assembly with attachable headband provides the appearance that a wearer has a full head of hair by discreetly covering up hair loss. The assembly includes a head covering comprising a foundation and wefts of hair. The wefts of hair are coupled to and extend outwardly from the foundation. The foundation has a front wall wherein the front wall includes a front portion being free from the wefts of hair. A headband is couplable to the front portion of the head covering.

13 Claims, 5 Drawing Sheets

HEAD COVERING ASSEMBLY WITH ATTACHABLE HEADBAND

BACKGROUND OF THE DISCLOSURE

Field of the Disclosure

The disclosure relates to head covering assemblies and more particularly pertains to a new head covering assembly for providing the appearance that a wearer has a full head of hair by discreetly covering up hair loss.

SUMMARY OF THE DISCLOSURE

An embodiment of the disclosure meets the needs presented above by generally comprising a head covering comprising a foundation and wells of hair. The wefts of hair are coupled to and extend outwardly from the foundation. The foundation has a front wall wherein the front wall includes a front portion being free from the wells of hair. A headband is couplable to the front portion of the head covering.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
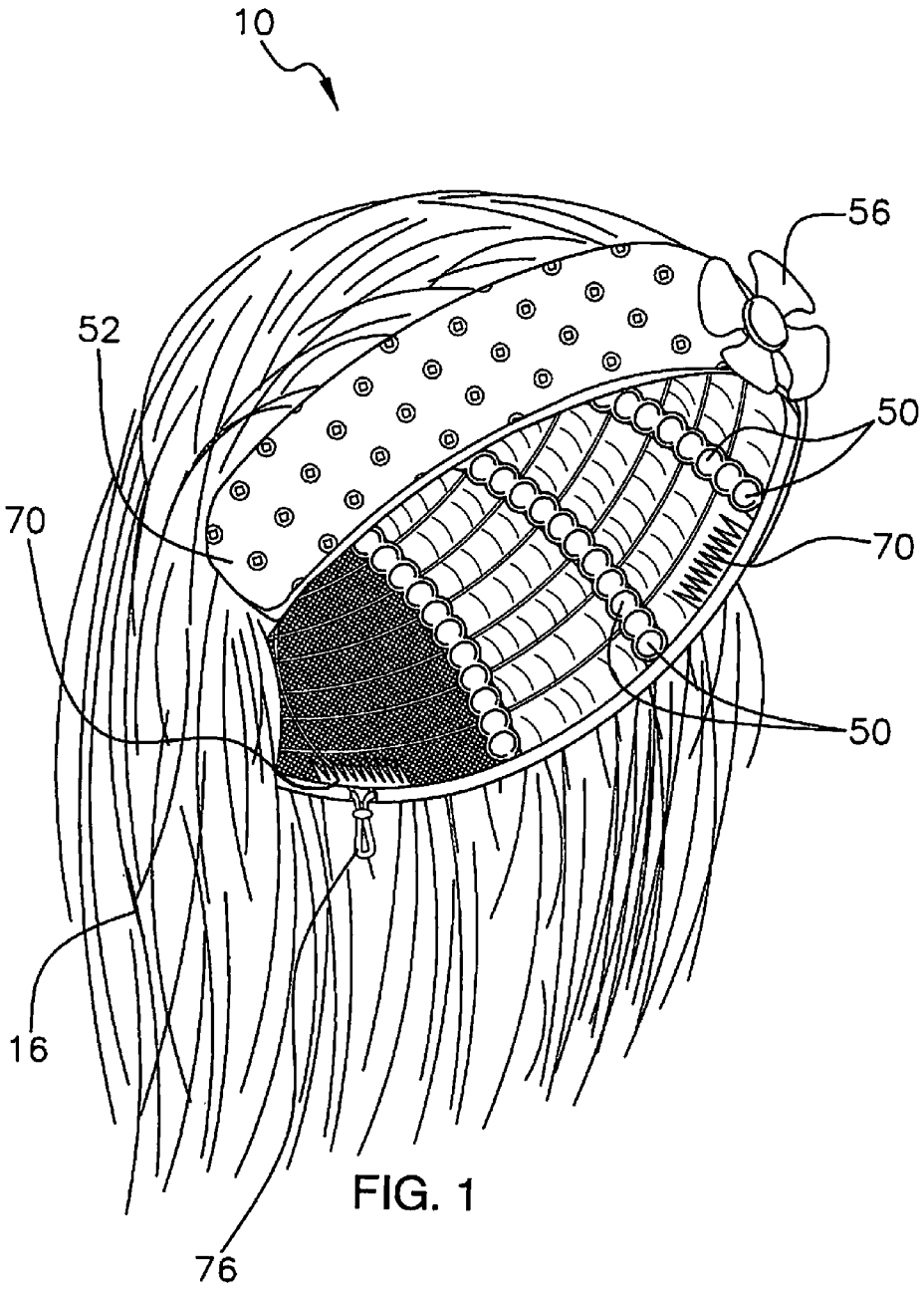
FIG. 1 is a top front side perspective view of a head covering assembly with attachable headband according to an embodiment of the disclosure.
Figure 2:
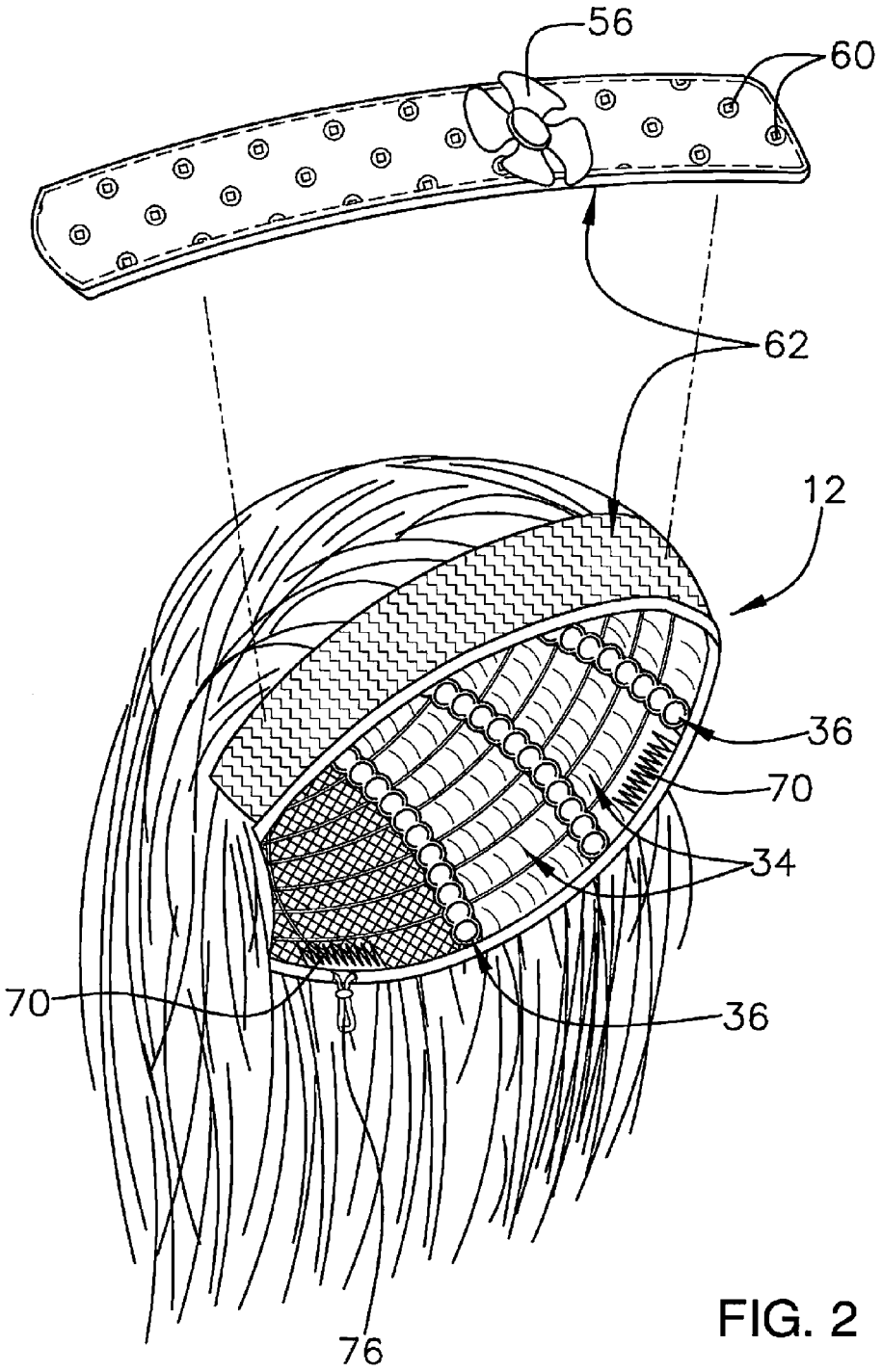
FIG. 2 is an exploded top front side perspective view of an embodiment of the disclosure.

With reference now to the drawings, and in particular to FIGS. 1 through 6 thereof, a new head covering assembly embodying the principles and concepts of an embodiment of the disclosure and generally designated by the reference numeral 10 will be described.

As best illustrated in FIGS. 1 through 6, the head covering assembly with attachable headband 10 generally comprises a head covering 12 comprising a foundation 14 and wefts of hair 16. The wefts of hair 16 are coupled to and extend outwardly from the foundation 14. The wefts of hair 16 may include different types of hair, including human hair, synthetic hair, hair with or without bangs 28, curly hair, straight hair or the like. The foundation 14 has a front wall 18, a back wall 20, a first lateral wall 22 and a second lateral wall 24. The foundation 14 may be convexly arcuate so as to conform to a shape of a head of a wearer of the head covering 12. The front wall 18 includes a front portion 26 being free from the wefts of hair 16.

The foundation 14 further comprises a lower band 30, a pair of first sections 32, a plurality of second sections 34, and a plurality of third sections 36. As seen in FIGS. 1 and 2, 4, and 5, the first sections 32, second sections 34 and third sections 36 may be provided in different configurations consistent with the drawing figures and the description below. A bottom edge 38 of the lower band 30 defines an access opening to an inner surface 40 of the head covering 12. A bottom edge 42 of the front portion 26 is coupled to an upper edge 44 of the lower band 30. The first sections 32 comprise an open-weaved net coupled to the upper edge 44 of the lower band 30. The first sections 32 comprise a first one 46 of the first sections 32 and a second one 48 of the first sections 32. The first one 46 of the first sections 32 may extend across the front wall 18. The second one 48 of the first sections 32 may extend from the back wall 20 toward the front wall 18. Each of the first sections 32 may be spaced from each other. Each of the first sections 32 extends across the inner surface 40 of the head covering 12 wherein the first sections 32 are configured to provide ventilation to the wearer of the head covering 12 due to their open-weaved nature. The first sections 32 may comprise a mesh material or the like. Each of the second sections 34 extends across the inner surface 40 of the head covering 12. Each of the second sections 34 may be coupled to an associated one of the first 22 and second 24 lateral walls. The second sections 34 comprise the wefts of hair 16 being weaved into the foundation 14. Each of the third sections 36 comprises adjacently positioned balls 50. Each of the third sections 36 extends across the inner surface 40 of the head covering 12. The third sections 36 are configured to provide a secure fit around a head of the wearer. Each of the first 32, second 34 and third 36 sections are coupled to and extend inwardly from the lower band 30.

Figure 3:
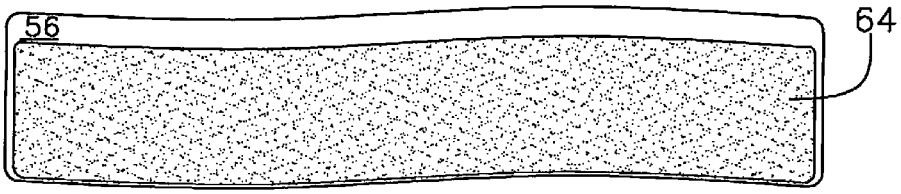
FIG. 3 is a bottom view of a headband of an embodiment of the disclosure.
Figure 4:
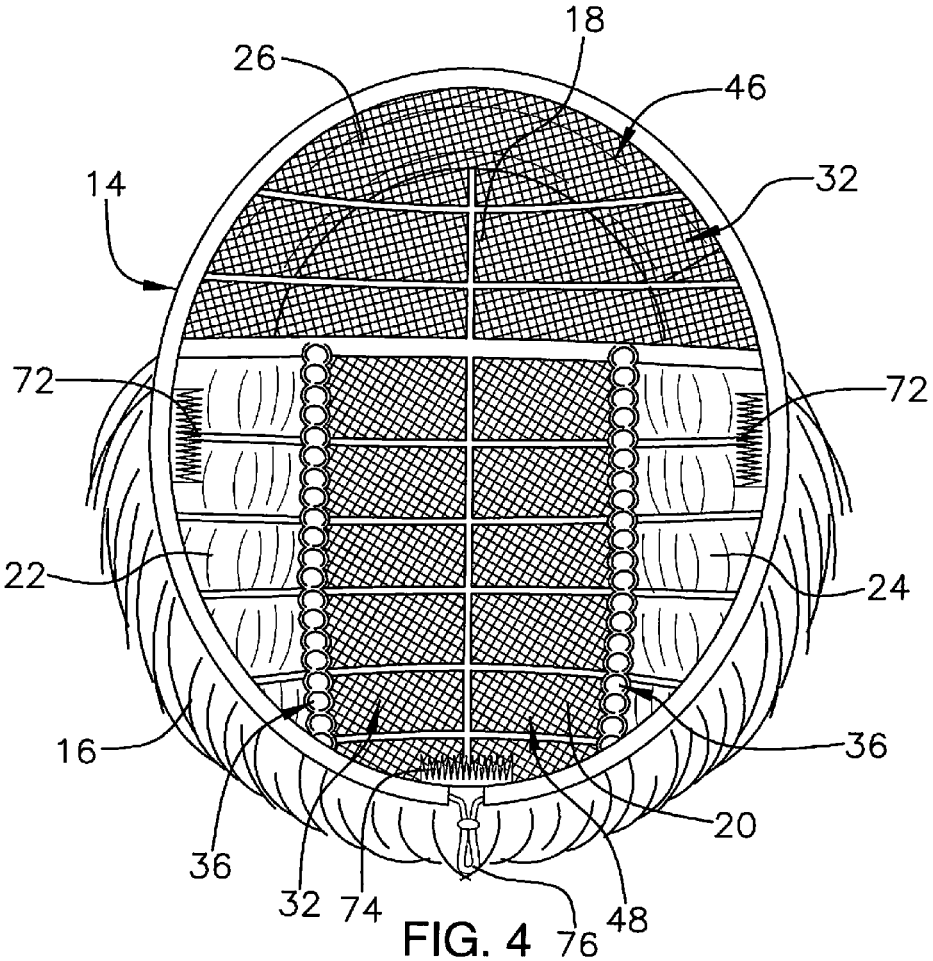
FIG. 4 is a bottom view of a head covering of another embodiment of the disclosure.
Figure 5:
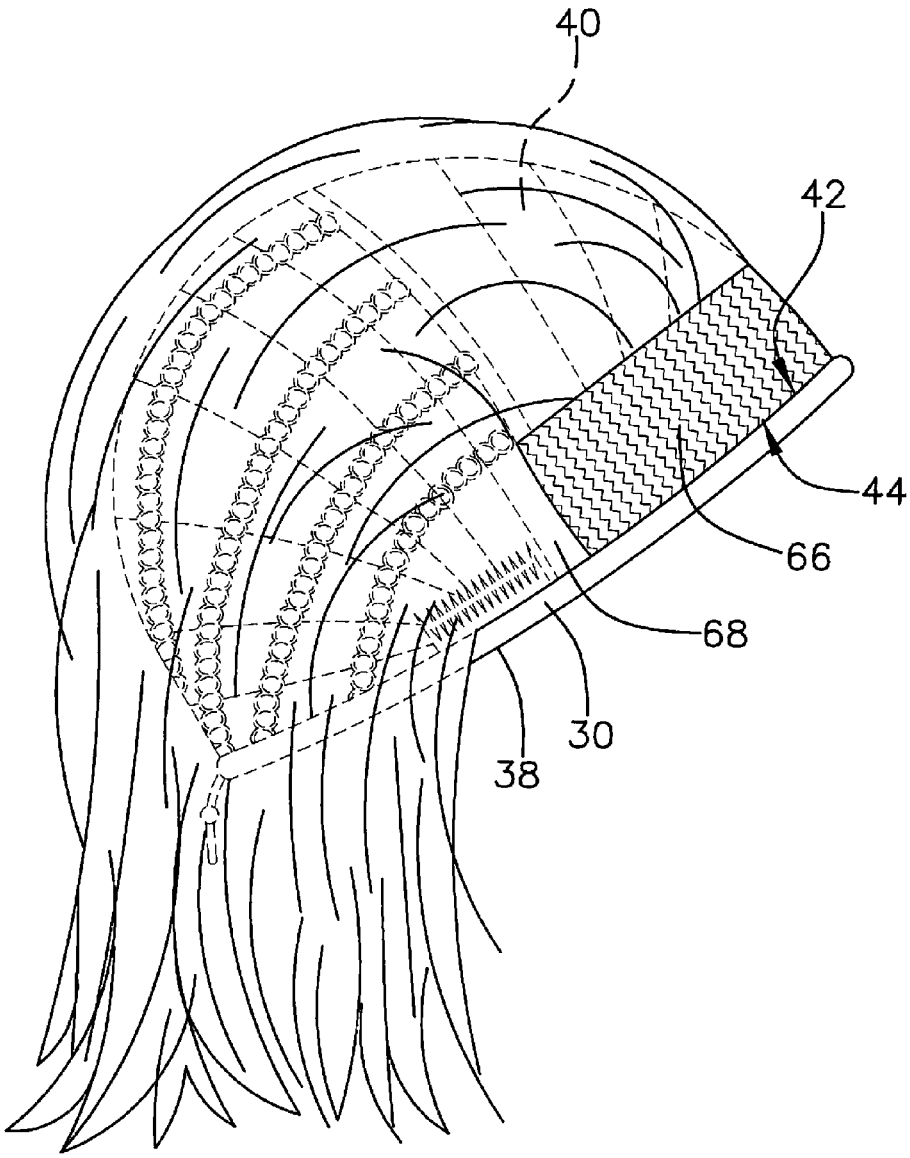
FIG. 5 is a side view of a head covering of another embodiment of the disclosure.
Figure 6:
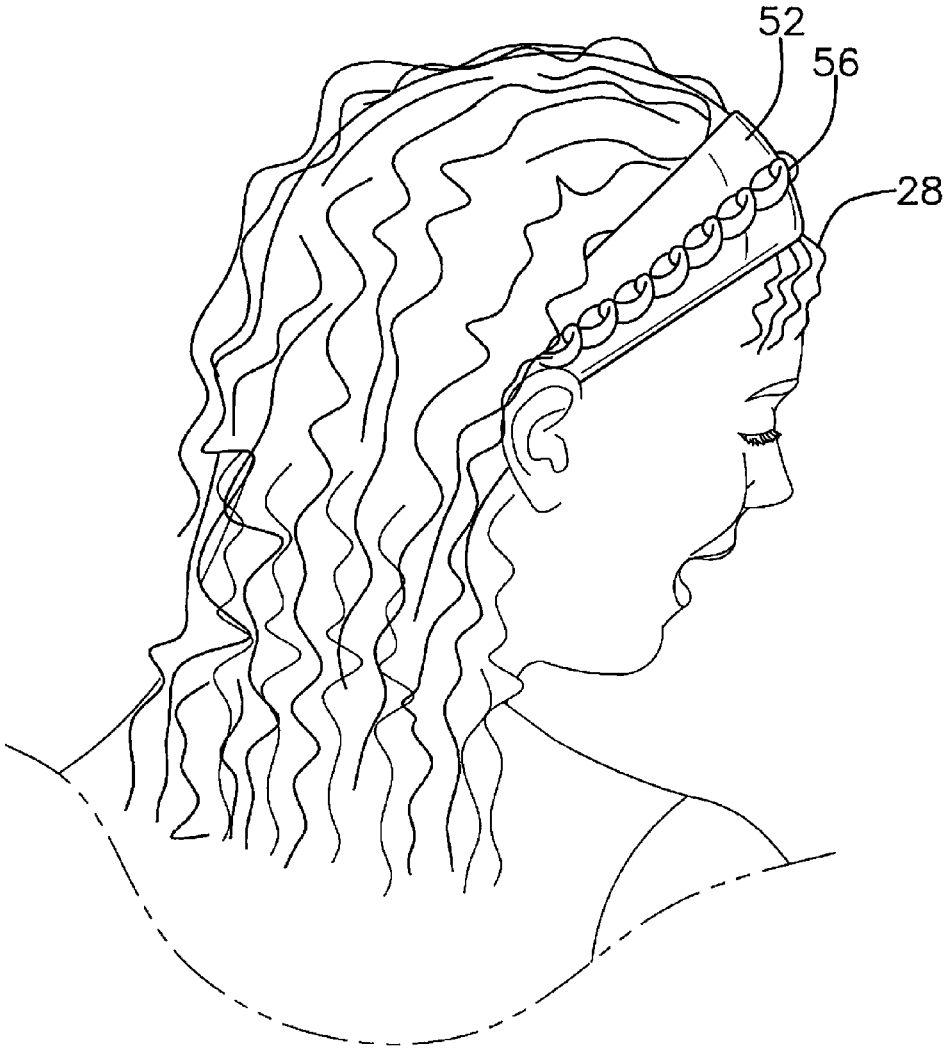
FIG. 6 is an in-use side view of an embodiment of the disclosure.

A headband 52 is removably coupled to the head covering 12. The headband 52 is comprised of a flexible material such as cloth or the like. The headband 52 has a first surface 54 and a second surface 56. A decorative object 58 may be coupled to the first surface 54 of the headband 52. The decorative object 58 may include a flower, an intertwined projecting pattern or the like. Decorative indicia 60 may also be positioned on the first surface 54 of the headband 52. A coupler 62 removably couples the headband 52 to the head covering 12. The coupler 62 may comprise complementary portions 64, 66 of a hook and loop fastener. One of the complementary portions 64 of the hook and loop fastener is positioned on the second surface 56 of the headband 52 and may cover substantially all of the second surface 56 as shown in FIG. 3. One of the complementary portions 66 of the hook and loop fastener is positioned on an exterior portion 68 of the head covering 12 and covers the front portion 26 of the foundation 14. Instead of a hook and loop fastener, the headband 52 may be tied or otherwise attached to the head covering 12 in a conventional manner. The headband 52 may have a length between approximately 16.0 centimeters and 38.0 centimeters; and a width between approximately 2.5 centimeters and 10.5 centimeters.

A plurality of combs 70 is coupled to the head covering 12. The combs 70 comprise a pair of outer combs 72 and a rear comb 74. The outer combs 72 may be coupled to oppositely positioned ones of the second sections 34. The rear comb 74 is positioned on the back wall 20 and is coupled to the second one 48 of the first sections 32. Each of the combs 70 is coupled to the inner surface 40 of the head covering 12 proximate the upper edge 44 of the lower band 30 wherein the combs 70 are configured to retain the head covering 12 upon the wearer's head. For a more secure fit, a drawstring 76 is coupled to the head covering 12 around the lower band 30. Alternatively, an adjustable strap may be provided instead of the drawstring 76 and coupled to the head covering 12 using hook and loop fasteners, hook and eye closures or the like.

In use, as stated above and shown in the Figures, the headband 52 is attached to the head covering 12 using the coupler 62 as described above. The head covering 12 is positioned over a head of the wearer. The combs 70 and the drawstring 76 secure the head covering 12 to the wearer's head. In this manner, the wearer appears to have a full head of hair while wearing the assembly 10.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A head covering assembly with attachable headband comprising:

a head covering comprising a foundation and wefts of hair, said wefts of hair being coupled to and extending outwardly from said foundation, said foundation having a front wall, a back wall, a first lateral wall and a second lateral wall, said front wall including a front portion being free from said wefts of hair; and a headband being couplable to said front portion of said head covering;

a lower band, a bottom edge of said lower band defining an access opening to an inner surface of said head covering;

said foundation further including a first section, said first section comprising an open-weaved net coupled to an upper edge of said lower band, said first section extending across said inner surface of said head covering wherein said first section is configured to provide ventilation to a wearer of said head covering;

said foundation further including a plurality of second sections, each of said second sections extending across said inner surface of said head covering, said second sections comprising said wefts of hair being weaved into said foundation; and said foundation further including a plurality of third sections, each of said third sections comprising adjacently positioned balls such that each said third section extends inwardly relative to said inner surface of said head covering wherein said third sections are configured for contacting and conforming to a shape of a human head, each of said third sections extending across said inner surface of said head covering, said third sections being configured to provide a secure fit around a head of the wearer, each of said first, second and third sections being coupled to and extending inwardly from said lower band.

2. The assembly of claim 1, further comprising said foundation being convexly arcuate.

3. The assembly of claim 1, further comprising said first section comprising a mesh material.

4. The assembly of claim 1, further comprising said first section being one of a pair of said first sections, said first sections comprising a first one of said first sections and a second one of said first sections, said first one of said first sections extending across said front wall, said second one of said first sections extending from said back wall toward said front wall, each of said first sections being spaced from each other.

5. The assembly of claim 1, further comprising each of said second sections being coupled to an associated one of said first and second lateral walls.

6. The assembly of claim 1, further comprising:

wherein said headband is removably coupled to said head covering; and a coupler releasably coupling said headband to said head covering.

7. The assembly of claim 6, further comprising said coupler comprising complementary portions of a hook and loop fastener, one of said complementary portions of said hook and loop fastener being positioned on a second surface of said headband, one of said complementary portions of said hook and loop fastener being positioned on an exterior portion of said head covering and covering said front portion of said foundation.

8. The assembly of claim 1, further comprising a decorative object coupled to a first surface of said headband.

9. The assembly of claim 1, further comprising decorative indicia being positioned on a first surface of said headband.

10. The assembly of claim 1, further comprising a drawstring coupled to said head covering around said lower band.

11. The assembly of claim 1, further comprising a comb coupled to said head covering, said comb being coupled to said inner surface of said head covering proximate an upper edge of said lower band wherein said comb is configured to retain said head covering upon a head of a wearer.

12. The assembly of claim 11, further comprising said comb being one of a plurality of said combs, said combs comprising a pair of outer combs and a rear comb, said outer combs being coupled to oppositely positioned ones of said second sections, said rear comb being positioned on said back wall and coupled to said first section.

13. A head covering assembly with attachable headband comprising:

a head covering comprising a foundation and wefts of hair, said wefts of hair being coupled to and extending outwardly from said foundation, said foundation having a front wall, a back wall, a first lateral wall and a second lateral wall, said foundation being convexly arcuate, said foundation further comprising a lower band, a bottom edge of said lower band defining an access opening to an inner surface of said head covering;

a pair of first sections, said first sections comprising an open-weaved net coupled to an upper edge of said lower band, said first sections comprising a first one of said first sections and a second one of said first sections, said first one of said first sections extending across said front wall, said second one of said first sections extending from said back wall toward said front wall, each of said first sections being spaced from each other, each of said first sections extending across said inner surface of said head covering wherein said first sections are configured to provide ventilation to a wearer of said head covering, said first sections comprising a mesh material;

a plurality of second sections, each of said second sections extending across said inner surface of said head covering, each of said second sections being coupled to an associated one of said first and second lateral walls, said second sections comprising said wefts of hair being weaved into said foundation;

a plurality of third sections, each of said third sections comprising adjacently positioned balls such that each said third section extends inwardly relative to said inner surface of said head covering wherein said third sections are configured for contacting and conforming to a shape of a human head, each of said third sections extending across said inner surface of said head covering, said third sections being configured to provide a secure fit around a head of the wearer, each of said first, second and third sections being coupled to and extending inwardly from said lower band; and wherein said front wall includes a front portion being free from said wefts of hair, a bottom edge of said front portion being coupled to said upper edge of said lower band;

a headband being removably coupled to said head covering, said headband having a first surface and a second surface;

a decorative object coupled to said first surface of said headband;

decorative indicia being positioned on said first surface of said headband;

a coupler releasably coupling said headband to said head covering, said coupler comprising complementary portions of a hook and loop fastener, one of said complementary portions of said hook and loop fastener being positioned on said second surface of said headband, one of said complementary portions of said hook and loop fastener being positioned on an exterior portion of said head covering and covering said front portion of said foundation;

a plurality of combs coupled to said head covering, said combs comprising a pair of outer combs and a rear comb, said outer combs being coupled to oppositely positioned ones of said second sections, said rear comb being positioned on said back wall and coupled to said second one of said first sections, each of said combs being coupled to said inner surface of said head covering proximate said upper edge of said lower band wherein said combs are configured to retain said head covering upon the wearer's head; and a drawstring coupled to said head covering around said lower band.

* * * * *